US006766629B2

(12) United States Patent
Smith, Jr. et al.

(10) Patent No.: US 6,766,629 B2
(45) Date of Patent: Jul. 27, 2004

(54) FRONT MOUNTED PRODUCT INSERTION IN A SWING ARM STYLE MAIL INSERTING MACHINE

(75) Inventors: Richard L. Smith, Jr., Bradley, IL (US); Ronald W. Niebauer, Jr., Downers Grove, IL (US)

(73) Assignee: AR International, Inc., Palos Park, IL (US)

( * ) Notice: Subject to any disclaimer, the term of this patent is extended or adjusted under 35 U.S.C. 154(b) by 0 days.

(21) Appl. No.: 10/170,137

(22) Filed: Jun. 12, 2002

(65) Prior Publication Data

US 2003/0230047 A1 Dec. 18, 2003

(51) Int. Cl.[7] ..... B65B 35/50

(52) U.S. Cl. ..... 53/474; 53/447; 53/569; 53/238

(58) Field of Search ..... 53/155, 249, 254.3, 53/445, 55, 494, 57, 500, 498, 569, 266, 284.3, 237, 238, 540, 474, 447; 414/789.6, 793; 198/468.4, 448

(56) References Cited

U.S. PATENT DOCUMENTS

| | | | | | |
|---|---|---|---|---|---|
| 3,797,196 | A | | 3/1974 | Harbison | |
| 3,981,394 | A | | 9/1976 | Slathar et al. | |
| 4,462,199 | A | * | 7/1984 | Polit | 53/284.3 |
| 4,677,808 | A | | 7/1987 | Chenevard | |
| 4,798,040 | A | | 1/1989 | Haas et al. | |
| 4,865,304 | A | | 9/1989 | Vandersyde et al. | |
| 4,921,388 | A | * | 5/1990 | Nelson | 414/412 |
| 4,922,689 | A | | 5/1990 | Haas et al. | |
| 4,938,007 | A | | 7/1990 | Sperry | |
| 4,955,185 | A | | 9/1990 | Haas et al. | |
| 5,000,434 | A | | 3/1991 | VanderSvde et al. | |
| 5,220,770 | A | | 6/1993 | Szewczyk et al. | |
| 5,425,217 | A | | 6/1995 | Lobash et al. | |
| 5,640,831 | A | | 6/1997 | Harrod et al. | |
| 5,655,354 | A | * | 8/1997 | Baker et al. | 53/474 |
| 5,878,554 | A | | 3/1999 | Loree et al. | |
| 5,881,538 | A | | 3/1999 | Blohm | |
| 5,923,015 | A | | 7/1999 | Hill et al. | |
| 5,950,401 | A | | 9/1999 | Blohm et al. | |
| 6,070,385 | A | * | 6/2000 | Antonio | 53/53 |
| 6,470,653 | B1 | * | 10/2002 | Lutz et al. | 53/526 |
| 2003/0084642 | A1 | * | 5/2003 | Cheung et al. | 53/249 |

* cited by examiner

*Primary Examiner*—Rinaldi I. Rada
*Assistant Examiner*—John Paradiso
(74) *Attorney, Agent, or Firm*—Cardinal Law Group

(57) ABSTRACT

A method and apparatus for automatically operating a swing-arm-style mail insertion machine to insert products, such as CDs, computer diskettes, credit cards, matchbooks, pens and pencils, keys, etc., into envelopes at high speeds is provided by fixedly attaching, to a swing arm shaft of the swing-arm insertion machine for angular movement therewith, an actuator arm apparatus having an element configured for gripping a product from the front of a raceway of the swing-arm machine when the swing arm shaft is in a front angular position, and for placing the product into the raceway as the swing arm shaft pivots from the front angular position to a rear angular position, and feeding a product from the front of the raceway into the raceway with the actuator arm means. The actuator arm apparatus may be installed at one or more stations of the swing-arm machine and used simultaneously with a swing-arm also installed at the same station for depositing both a first item and a product into the raceway at the station, as the swing arm shaft pivots from the rear to the front, and the front to the rear angular positions respectively of the swing arm shaft. Automatic controls are provided for monitoring proper insertion of the products, and shutting down the swing-arm machine, if necessary, so that corrective action can be taken.

23 Claims, 5 Drawing Sheets

FRONT MOUNTED PRODUCT INSERTION IN A SWING ARM STYLE MAIL INSERTING MACHINE

TECHNICAL FIELD OF THE INVENTION

This invention relates to swing arm style mail insertion machines, and more particularly to high speed insertion of products, such as compact disks, computer diskettes, credit cards, keys, etc., into envelopes with a swing arm style mail insertion machine.

BACKGROUND OF THE INVENTION

High speed insertion machines have been used for many years to insert relatively flat and flexible paper items such as bills, envelopes for returning payment of the bill, account information, coupons, and advertising materials into a common envelope for mailing to a recipient.

FIGS. 1 and 2 depict one type of such a high speed insertion machine, known as a "multi-station, swing-arm-style mail insertion machine" 10. The multi-station, swing-arm-style machine 10 includes a raceway 12 having a conveyor 14 therein that sequentially moves items 17 placed into the raceway 12 from hoppers 19 at a series of insertion stations 16 located at a rear side 18 of the raceway 12, for insertion into an envelope 20, as the conveyor 14 moves in the direction indicated by the arrow 22. The items are moved from the hopper 19 to the raceway 12 at each station 16 by a swing-arm 24, having an upper end fixedly attached for rotation therewith to a swing arm shaft 26. As shown in FIG. 2, the swing arm shaft 26 is pivotably mounted for angular movement about a swing arm shaft axis 28 between a rear angular position 30 and a front angular position 32 of the swing arm shaft 26 and swing arm 24. The distal end (i.e. the lower end as shown in FIG. 2) of the swing arm 24 includes gripping fingers 34 for grasping one of the items 17 in the hopper 19 at the station 16, when the swing arm shaft 26 and swing arm 24 are in the rear angular position 30, and for dropping the grasped item 17 into the raceway 12 as the swing arm shaft 26 and swing arm 24 move from the rear angular position 30 to the front angular position 32.

Swing-arm style insertion machines 10 of the type described above are commonly used to fill envelopes with relatively flat and flexible paper items of the type listed above at rates up to 10,000 pieces per hour.

In recent years it has also become desirable to insert products such as compact disks (CDs), computer diskettes, stamps, credit cards, keys, match books, pencils or pens, etc., into envelopes for mailing with or in the same manner as the paper items that the swing-arm style insertion machines 10 were designed to handle. The gripping fingers 34 and hoppers 19 at the stations 16 of prior swing-arm style insertion machines 10 cannot handle such products, however. Even if the gripping fingers 34 and hoppers 19 of prior machines could feed such products, it would be undesirable to lose the ability to insert flat paper items 17 at an insertion station 16 used for inserting the product.

In one prior approach, the products are fed manually by hand, into the raceway 12 from the front side 36 of the raceway 12, at one or more of the stations 16, by a person operating the machine 10. With this approach, the rate at which the machine 10 can fill envelopes 20 is greatly reduced. Reliability of inserting the product is entirely dependent upon the skill, trustworthiness, and alertness of the person operating the machine 10. It is also not desirable for safety reasons to have the operator reaching into the raceway 12 with the swing arms 24 moving rapidly back and forth between the front and rear angular positions 32, 30.

In another approach, a stand-alone insertion machine, operating independently from the swing-arm machine 10, is used for inserting the product from the front side 36 of the raceway 12 at one or more of the stations 16. Because the stand-alone machine operates independently from the swing-arm machine 10, setting and maintaining the timing of insertion from the stand-alone machine to coordinate properly with movement of the swing arm 24 is difficult. It is typically necessary, therefore, to slow the swing-arm machine 10 down considerably to ensure proper timing of insertion of the product. It is also typically necessary to closely monitor the insertion operation to ensure that the standalone machine remains properly timed with respect to the swing-arm machine 10, and to stop and reset the two machines periodically. There is also typically no common means for monitoring and controlling the performance of both the swing-arm machine 10 and stand-alone machine, to shut down the machines and alert an operator if the hoppers 19 on the swing-arm machine 10 or the stand-alone machine need to be refilled, or a mis-feed condition occurs, necessitating high labor content for an operator to closely monitor operation of both machines.

What is needed, therefore, is an improved method and apparatus for feeding products such as those described above into envelopes, with a swing-arm-style mail insertion machine.

SUMMARY OF THE INVENTION

Our invention provides an improved method and apparatus for operating a swing-arm-style mail insertion machine, by fixedly attaching an actuator arm apparatus to the swing arm shaft of the swing arm insertion machine for feeding a product from a front side of a raceway of the swing-arm-style machine into the raceway. The actuator arm is configured for gripping a product from the front of the raceway of the swing-arm machine when the swing arm shaft is in a front angular position, and for placing the product into the raceway as the swing arm shaft pivots from the front angular position to a rear angular position.

Our actuator arm apparatus can be installed at a station of the swing-arm machine and used simultaneously with a swing-arm also installed at the same station, with the swing-arm depositing a first item into the raceway as the swing arm shaft pivots from the rear to the front, and the actuator arm apparatus depositing a product into the raceway as the swing arm shaft pivots from the front to the rear angular position.

Because our actuator arm device is attached to and operated by the swing arm shaft of the swing-arm insertion machine, the method and apparatus of our invention make it possible to automatically feed and insert products into envelopes at very high rates of feed up to 10,000 pieces per hour, in place of, or in conjunction with, the flat paper type of inserts for which such swing-arm insertion machines were originally designed.

Some forms of our invention may also include automatic controls for monitoring proper insertion of the products, and shutting down the swing-arm machine so that corrective action can be taken. Our invention may also include utilization of a front mounted product feeder channel that can be readily mounted on the front side of the raceway, and adapted to feed a wide variety of products.

The foregoing and other features and advantages of our invention will become further apparent from the following detailed description of exemplary embodiments, read in conjunction with the accompanying drawings. The detailed description and drawings are merely illustrative of our invention rather than limiting, the scope of the invention being defined by the appended claims and equivalents thereof.

DETAILED DESCRIPTION OF THE PRESENTLY PREFERRED EMBODIMENTS

Figures 1, 2:
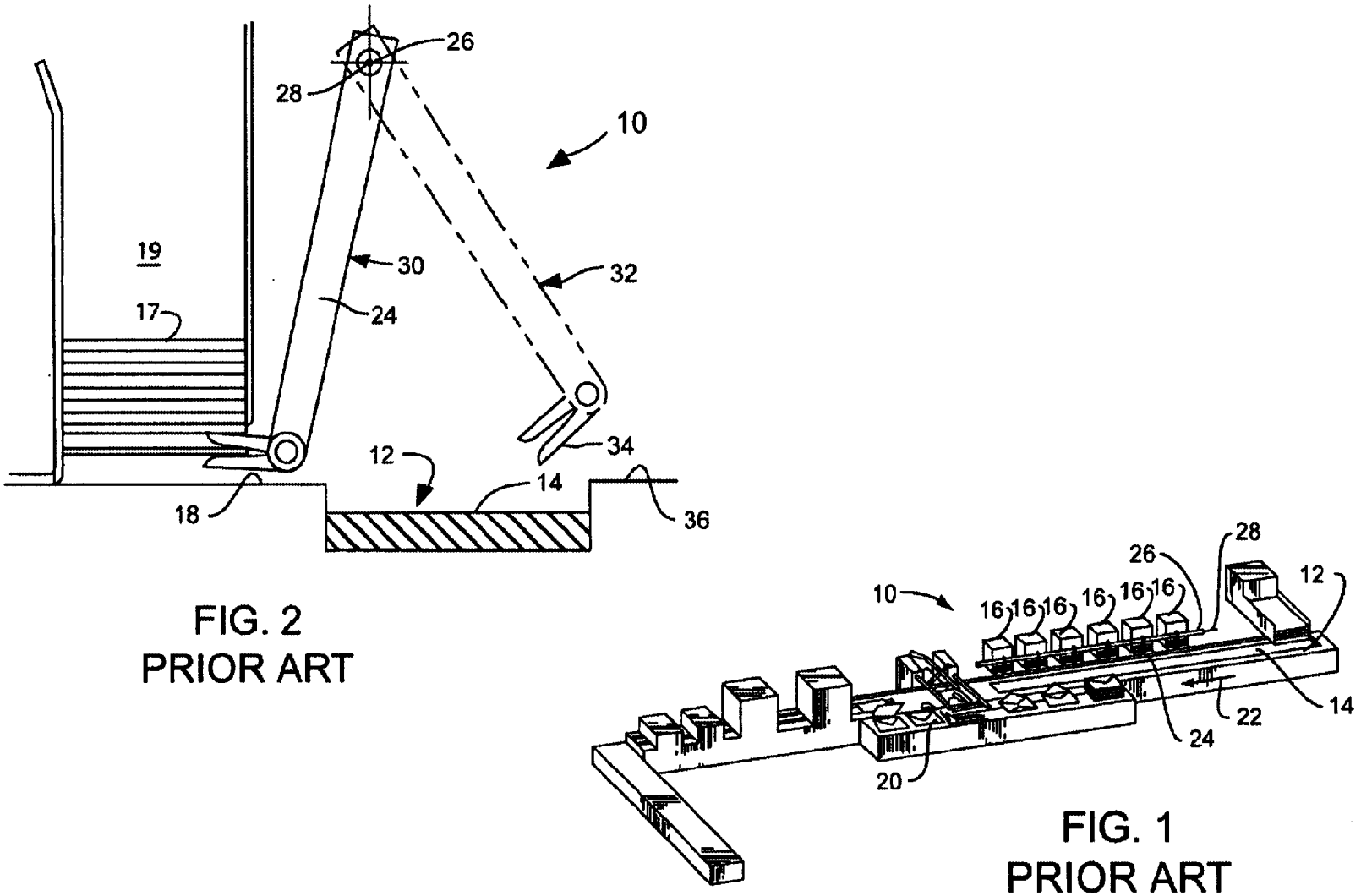
FIG. 1 PRIOR ART
FIG. 2 PRIOR ART
FIG. 1 is a perspective view of a prior multi-station swing-arm-style mail insertion machine.
FIG. 2 is a schematic cross-sectional representation taken at one of the stations of the prior multi-station swing-arm-style mail insertion machine shown in FIG. 1.

FIGS. 3 through 7 depict various aspects of an exemplary embodiment of a front mounted feeder apparatus 40, according to our invention, for inserting a product, such as a compact disk, computer diskette, credit card, or a key, etc., into an envelope with a swing arm style mail insertion machine 10, of the type shown in FIGS. 1 and 2. In the discussion that follows, like reference numerals will be used wherever possible for identifying elements and aspects of the exemplary embodiments of our invention depicted in FIGS. 3–7 that have similarity to the elements and aspects of the prior multi-station swing-arm-style mail insertion machine 10 shown in FIGS. 1 and 2.

Figure 3:
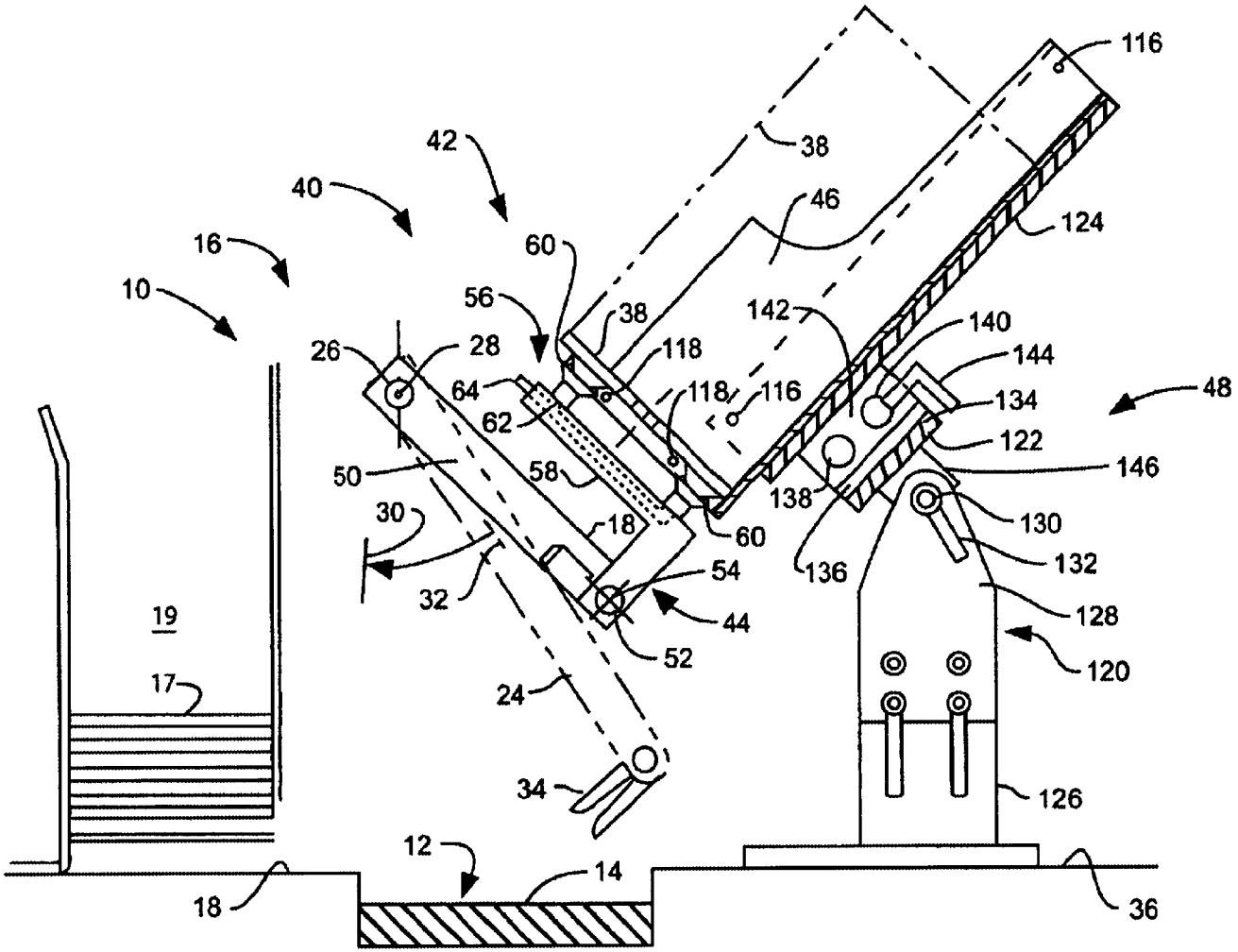
FIGS. 3 and 4 are schematic representations of a front mounted product feeder apparatus, according to our invention, with an actuator of the apparatus shown in a front angular position, and in a rear angular position, respectively.
Figure 4:
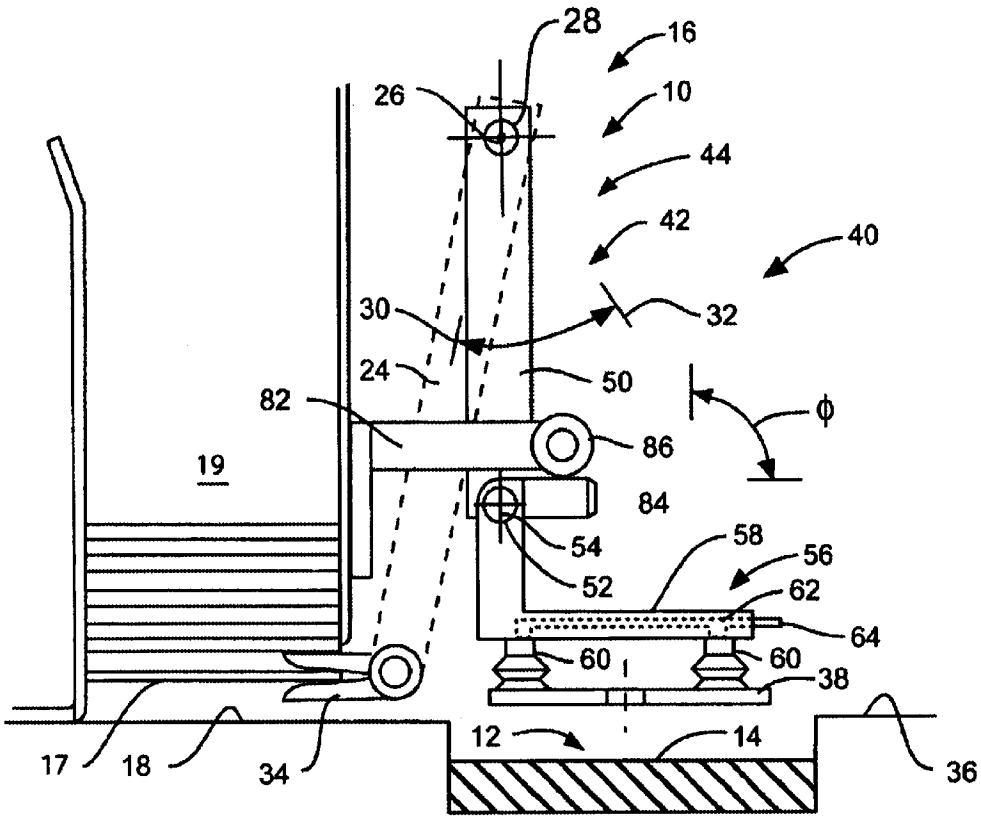

FIGS. 3 and 4 are schematic representations of a portion of the front mounted product feeder apparatus 40 including a swing-arm insertion machine 10 having a swing arm shaft 26, and front mounted product feeder means 42 operably connected to the swing arm shaft 26 at a station 16 of the swing-arm insertion machine 10, for feeding a product 38 into a raceway 12 at the station 16 from a front side 36 of the raceway 12.

The swing-arm insertion machine 10 includes the insertion station 16, and a conveyor 14 in the raceway 12, for moving material in the raceway 12 to and from the station 16. A hopper 19 is located on the rear side 18 of the raceway 12 for holding a plurality of first items 17 to be inserted into the raceway 12 at the station 16.

The swing arm shaft 26 of the insertion machine 10 is mounted to pivot about the swing arm shaft axis 28 from a rear angular position 30 to a front angular position 32 of the swing arm shaft 26. The swing arm shaft 26 is adapted for fixed attachment of the upper end of a swing arm 24, shown in dashed lines in FIGS. 3 and 4. The other (distal) end of the swing arm 24 includes gripping means, in the form of gripping fingers 34, for gripping one of the first items 17 in the hopper 19 when the swing arm shaft 26 is pivoted to the rear angular position 30, and for depositing the first item 17 into the raceway 12 as the swing arm shaft 26 pivots from the rear angular position 30 to the front angular position 32 of the swing arm shaft 26.

The front mounted product feeder means 42 includes actuator arm means 44, and a product feeder channel 46 attached to the front side 36 of the raceway 12 by means for mounting and aligning the product support channel 46, in the form of an adjustable mounting structure 48. FIGS. 3 and 4 provide a partial schematic representation of the actuator arm means 44.

The actuator arm means 44 includes an actuator arm 50 having an upper end thereof adapted for fixed attachment to the swing arm shaft 26, for pivotal movement of the actuator arm 50 with the swing arm shaft 26, about the swing arm shaft axis 28 between the front and rear angular positions 32, 30 of the swing arm shaft 26. The other (distal) end of the actuator arm 50 includes a support shaft 52 adapted for attachment of product gripper means 56. The support shaft 52 is pivotably mounted to the distal end of the actuator arm 50, for rotation about a support shaft axis 54.

The product gripper means 56 are operably attached to the support shaft 52 at the distal end of the actuator arm 50 for gripping a product 38 on the front side 36 of the raceway 12, while the swing arm shaft 26 is in the front angular position 32, and for placing the product 38 in the raceway 12 as the swing arm shaft 26 moves from the front angular position 32 to the rear angular position 30 of the swing arm shaft 26.

Figure 5:
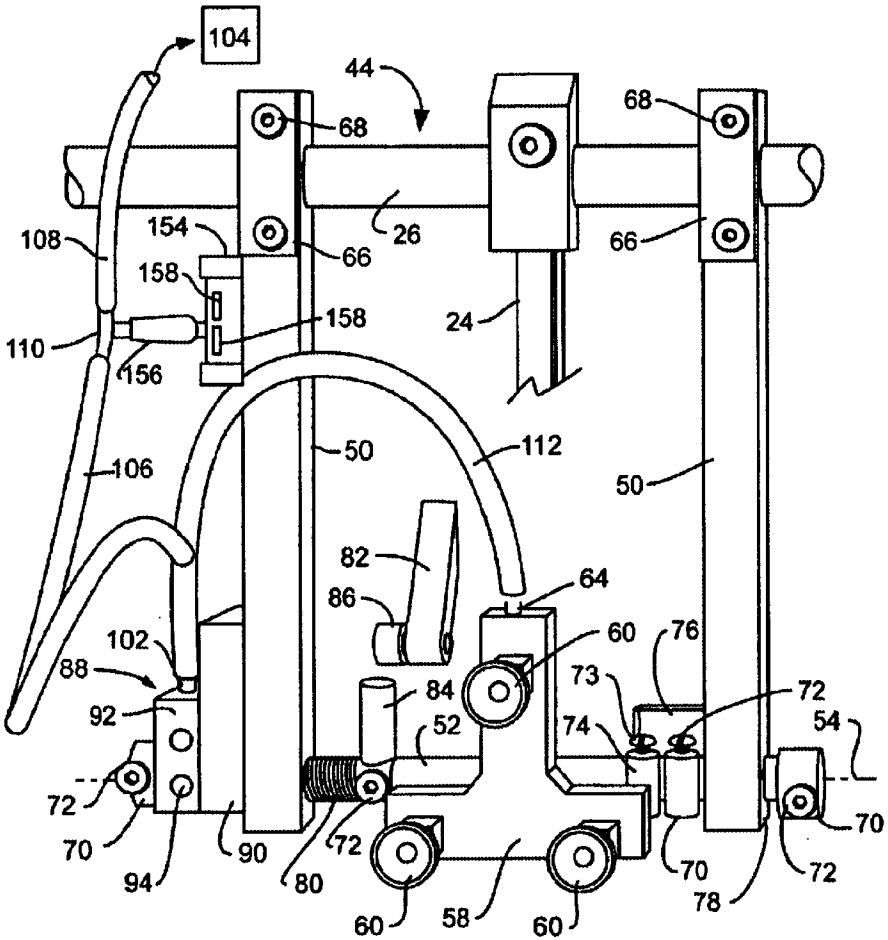
FIG. 5 is a perspective illustration of a portion of an exemplary embodiment of a front mounted feeder apparatus, according to our invention.

The product gripper means 56 include a product vacuum plate 58 fixedly attached to the vacuum plate support shaft 52, for rotation therewith, about the support shaft axis 54. The vacuum plate 58 includes means for attaching a suction cup 60 thereto, and for connecting the suction cup 60 to a source of vacuum. In the schematic illustrations shown in FIGS. 3 and 4, the vacuum plate 58 includes three suction cups 60 (only two of which are illustrated) arranged in a triangular array, as illustrated in FIG. 5. The suction cups 60 are connected together by a vacuum passages 62 in the vacuum plate 58, and joined to a tubular hose connection nipple 64 for connecting the vacuum passages 62 to a source of vacuum.

FIG. 5 shows an exemplary embodiment of the actuator arm means 44 illustrated schematically and described above in relation to FIGS. 3 and 4. In the exemplary embodiment, the actuator arm means 44 includes two actuator arms 50, hereinafter referred to as the left and right actuator arms 50 to facilitate understanding with reference to the location of the actuator arms 50 as illustrated on FIG. 5. The upper ends of the left and right arms 50 are fixedly attached to the swing arm shaft 26 by clamps 66 secured to the actuator arms 50 by cap screws 68. FIG. 5 also includes a partial illustration of a swing arm 24 having its upper end similarly clamped to the swing arm shaft 26 and secured to the swing arm 24 by a cap screw.

The support shaft 52 extends through holes in the lower end of both the left and right actuator arms 50, and is supported by bushings (not shown) within the holes for rotation about the support shaft axis 54. The support shaft 52 is secured to the actuator arms 50 by locking collars 70, secured to the shaft by locking screws 72.

The vacuum plate 58 is fixedly attached to the support shaft 52, for rotation therewith by a set screw (not shown). A tubular shaped first stop 76 extends from the right actuator arm 50 and operably bears against the product vacuum plate 58 through a portion of a locking screw 73 that extends from a first stop collar 74. The first stop collar 74 is clamped to the support shaft 52 by the locking screw 73 so that it moves with and effectively becomes one with the vacuum plate 58 and the support shaft 52. The locking screw 73 of the first stop collar 74 is positioned such that, when the locking screw 73 of the first stop collar 74 is bearing against the first stop 76, a first desired angular position θ of the product vacuum plate 58 is established with respect to the actuator arms 50, as shown in FIG. 3.

The first angular position θ of the product vacuum plate 58 is selected to present the suction cups 60 at a proper angle to readily grasp a product 38 from the product feeder channel 46, in a manner described in more detail below. For the embodiment depicted in FIG. 3, the first angular position θ of the product vacuum plate 58 is essentially zero degrees, with the vacuum plate 58 extending generally parallel to the actuator arms 50. Different first angular positions θ of the product vacuum plate 58 may be preferable in other embodiments of our invention, and may be obtained by repositioning the angular orientation on the support shaft 52 of the locking screw 73 in the first stop collar 74. The ability to adjust the first angular position θ of the product vacuum plate 58 also provides a convenient way to optimize the position of the suction cups 60 for reliable grasping of a product 38 from the product feeder channel 46.

A pair of torsion springs 78, 80 are operably connected between the actuator arms 50 and the product vacuum plate support shaft 52 for urging the product vacuum support plate 58, and also the first stop collar 74 to pivot about the support shaft axis 54, to bring the locking screw 73 of the first stop collar 74, and also effectively the vacuum plate 58 in the manner described above, into contact with the first stop 76. The spring force exerted by the torsion springs 78, 80 holds the product vacuum plate 58 in the first angular position θ with respect to the actuator arms 50, as the actuator arms 50 arm moved back and forth by the swing arm shaft 26.

Second stop means, include a second stop arm 82 attached to and extending from the swing arm inserting machine 10 in a fixed relationship to the raceway 12, and a second stop pin 84 extending radialy outward from and secured by a locking screw 72 to the support shaft 52 for rotation therewith. By virtue of the fixed connection of the both the second stop pin 84 and the vacuum plate 58 to the support shaft 52, the stop pin 84 operably functions as part of the vacuum plate 58 with regard to setting a rotational position of the vacuum plate 58 about the axis 54 of the support shaft 52. The second stop arm 82 includes a roller 86, at the distal end of the second stop arm 82, for reducing friction between the distal end of the second stop arm 82 and the second stop pin 84.

As shown in FIG. 4, the roller 86 is configured to bear against the product vacuum support plate 58, through the second stop pin 84 and support shaft 52, for rotating the product vacuum plate 58 from the first angular position θ of the product vacuum plate 58 with respect to the actuator arms 50, to a second angular position Φ of the product vacuum plate 58 with respect to the actuator arms 50, as the actuator arms 50 move from the front angular position 32 to the rear angular position 30 with the swing arm shaft 26. The second angular position Φ is substantially a right angle, as illustrated in the embodiment of FIG. 4, but can be adjusted to other angles by loosening the locking screw 72 securing the second stop pin 84 to the support shaft 52, rotating the stop pin 84 about the support shaft 52 to establish the desired second angular position Φ between the vacuum plate 58 and the actuator arms 50, and re-tightening the locking screw 72 to lock the second stop pin 84 to the support shaft 52 in the new position.

The front mounted product feeder apparatus 40 further includes valve means 88 for connecting and disconnecting the suction cups 60 from a source of vacuum. The valve means 88 connect the suction cups 60 to the source of vacuum, during a grasp and hold portion of the angular movement of the swing arm shaft 26, as the swing arm shaft 26 moves the actuator arms 50 between the front and rear angular positions 32, 30 of the swing arm shaft 26, while the actuator arm means 44 are grasping the product 38. The valve means 46 disconnect the suction cups 60 from the source of vacuum during a product placement portion of the angular movement of the swing arm shaft 26 between the front and rear angular positions 32, 30 of the swing arm shaft 26, at a point where the gripper means 56 are positioned over the raceway in such a manner that disconnection of the suction cups 60 from the source of vacuum will cause the product 38 being grasped and held by the gripper means 56 to be released from the gripper means 56 and dropped into the raceway 12.

Figure 6:
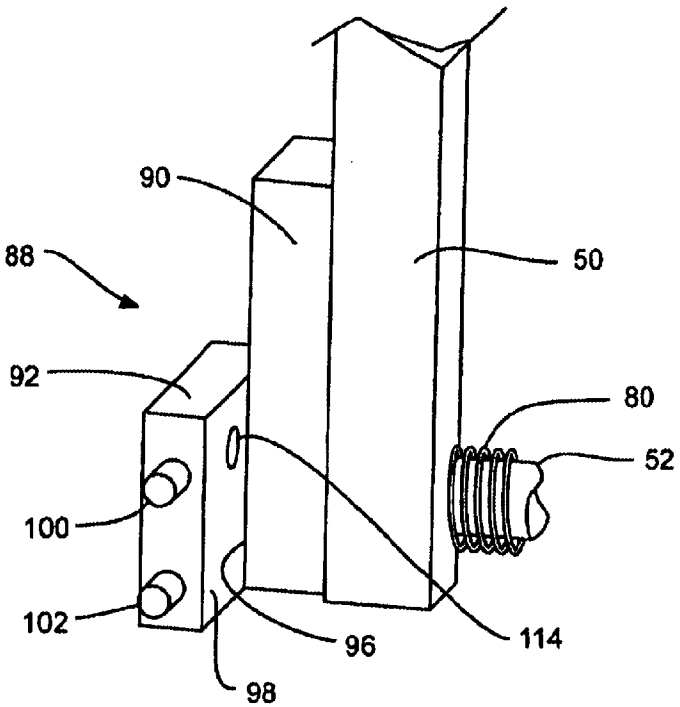
FIG. 6 is a perspective illustration of valve elements for controlling application of vacuum to a suction cup of a gripper apparatus for the front mounted feeder apparatus illustrated in FIG. 5.

As shown in FIGS. 5 and 6, the valve means 88 includes a stationary sealing block, in the form of a stationary valve block 90 attached to the left actuator arm 50, and a rotating vacuum block, in the form of a rotating valve block 92 fixedly attached to the support shaft 52 by a set screw 94 for rotation with the support shaft 52 about the support shaft axis 54. The stationary sealing block 90 has a sealing face 96 thereof, adapted for sliding contact with mating a sealing face 98 of the rotating vacuum block 92.

The rotating vacuum block 92 includes an internal vacuum passage (not shown) therein connecting a vacuum inlet port 100 and a vacuum outlet port 102. The vacuum inlet port 100 is adapted for attachment of the vacuum passage to a source of vacuum 104 via hoses 106, 108, and a tee connector 110. The vacuum outlet port 102 is adapted for attachment via the vacuum passage to the hose connection nipple 64 of the product vacuum plate 58, through a vacuum hose 112. The sealing face 98 of the rotating vacuum block 92 includes a control port 114 therein, connected to the internal vacuum passage of the rotating valve block 92. The control port 114 is disposed upon the sealing face 98 of the rotating block 92 in such a position that the control port 114 remains covered and closed by the sealing face 96 of the stationary block 90, until the product vacuum plate 58 is adjacent the second angular position Φ of the product vacuum plate 58 with respect to the actuator arms 50, whereat the control port 114 is uncovered to thereby release the vacuum in the vacuum passage of rotating valve block 92, the hose 112, the internal vacuum passages 62 of the vacuum plate 58, and the suction cups 60, so that the product 38 may drop into the raceway 12.

The rotating valve block 92 is moved to the position where the control port is uncovered by the action of the second stop arm and pin 82, 84 rotating the support shaft 52 as the swing arm shaft 26 moves from the front angular position 32 to the rear angular position 30. As the swing arm shaft 26 moves the actuator arms 50 from the rear angular position 30 back toward the front angular position 32 of the swing arm shaft 26, the torsion springs 78, 80 rotate the support shaft 52, the rotating valve block 92, and the vacuum plate 58 back toward the first angular position θ of the vacuum plate 58. As the rotating valve block 92 is pivoted back, the control port 114 in the sealing face 98 of the rotating valve block reaches a point where the control port 114 is once again covered by the sealing face 96 of the stationary valve block 90 to thereby re-establish vacuum at the suction cups 60 by the time the vacuum plate 58 reaches the first angular position θ, so that the suction cups can grip another product 38 from the product support feeder channel 46.

The product support feeder channel 46 shown in FIG. 3 is specially configured for delivering a product 38 in the form of a compact disk, or a DVD, as shown in FIGS. 3 and 4. The product support feeder channel 46 is uniquely configured for each type of product 38 to be inserted. Product feeder channels 46 for a product 38 in the form of a credit card, or a computer diskette, for instance, would have a different shape than the product feeder channel 46 depicted herein for feeding CDs and DVDs. To facilitate changeover from one type of product 38 to another, we contemplate that the product feeder channels 46 for various types of products 38 are attached to the mounting structure 48 by fasteners 116, as shown in FIG. 3. The product feeder channel 46 may also include features, such as the adjustable separator screws 118 shown in FIG. 3, for holding and properly positioning the products 38 in the feeder channel 46 so that they can be readily grasped and removed one-at-a-time by the gripper means 56.

As shown in FIG. 3, the mounting structure 48 includes a number of features allowing the position of the product feeder channel 46 to be readily adjusted for holding the product 38 at an optimal position to be gripped by the suction cups 60. The mounting structure 48 includes an adjustable pedestal 120, a horizontal mounting rail assembly 122, and a pair of angle-iron shaped feeder channel mounting rails 124.

The pedestal 120 includes a base 126 adapted at its lower end for attachment to a surface at the front side 36 of the raceway 12. For convenience of mounting, the base 126 may include magnetic or suction cup elements for securing the base 126 to the surface at the front side of the raceway 12. Alternatively, the base 126 may be bolted or clamped to the surface. The upper portion 128 of the pedestal is connected to the base 126 by a series of set screws that pass through vertical slots in the base 126 and engage a sliding nut plate inside the pedestal, to allow adjustment of the vertical height of the pedestal 120. The upper end of the upper portion 128 of the pedestal includes a shaft 130 and a quick release lever mechanism 132 for adjusting and locking the shaft 130 in a desired angular position.

The horizontal mounting rail assembly 122 includes a U-shaped frame, shown in cross section in FIG. 3, having a horizontal bar 134 connecting a pair of vertical end plates 136. A pair of guide rails 138, 140 are attached between the end plates 136, and adapted for sliding engagement with a pair of mounting blocks 142, each adapted for attachment thereto of one of the feeder channel mounting rails 124. Each of the mounting blocks 142 includes a quick release set screw 144 adapted to bear against a flat on one of the rails 140, for locking the mounting block 142 horizontally in position along the rails 138, 140, so that the horizontal position of the feeder channel mounting rails 124 may be readily adjusted relative to one another to accommodate product feeder channels 46 of varying configurations. The position of the mounting blocks may also be adjusted while a feeder channel 46 is attached to the feeder channel mounting rails 124, for aligning the feeder channel 46 horizontally to present the product 38 in a optimal position to be gripped by the suction cups 60. The horizontal mounting rail assembly 122 also includes an apertured ear 146 attached to and extending from the horizontal bar 134 for fixed attachment to the shaft 130 of the pedestal 120. With the mounting rail assembly 122 attached in this manner to the shaft 130, the angular position of the feeder channel 46. Hence, the product 38 in the feeder channel 46, may be readily adjusted for optimal presentation of the product 38 to the suction cups 60.

Figure 7:
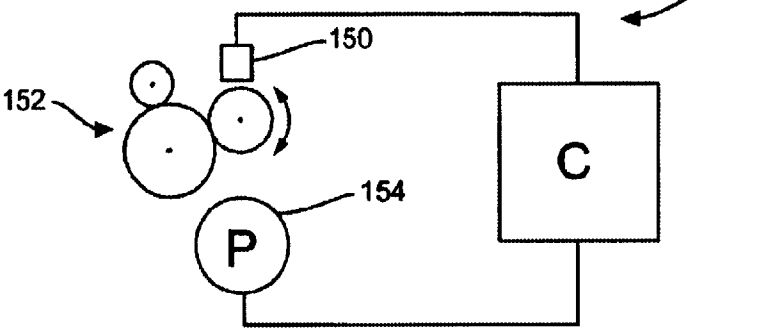
FIG. 7 is a schematic representation of an exemplary embodiment of a control circuit for a front mounted feeder apparatus, according to our invention.

As shown in FIGS. 5 and 7, the exemplary embodiment of our front feeder apparatus 40 also includes control means 148, in the form of a position sensor 150, a pressure sensor P, and a control element C, for sensing that the product gripper means 56 are properly delivering a product to the raceway 12. The control element C is configured to shut down the swing-arm machine 10, in the event that the front mounted product feeder apparatus 40 runs out of the product 38, or fails to deliver a product 38 into the raceway 12 when it should.

The position sensor 150 is operably located to detect angular movement of the swing arm shaft 26 from the front and to the rear angular positions 32, 30, for sensing that the shaft 26 is in the grasp-and-hold portion of the angular movement between the front and rear angular positions 32, 30 of the swing arm shaft 26. The position sensor may be mounted to directly sense the angular position of the swing arm shaft 26, or may alternatively be mounted to sense the motion of another shaft in a drive train 152 of the swing-arm machine 10, as illustrated in FIG. 7.

The pressure sensor P is a vacuum operated switch 154 having a suction port connected via a hose 156 to the tee 110, as shown in FIG. 5, and thereby also operably connected through hoses 106 and 112, the valve means 88, and the internal vacuum passages 62 in the vacuum plate 58, to the suction cups 60 for ascertaining that there is vacuum at the cups 60, caused by a product 38 being grasped by the suction cups 60, when the valve means 88 are positioned such that the control port 114 is covered and the suction cups 60 are connected to the source of vacuum 104. As the valve means 88 apply and remove vacuum, the vacuum switch 154 changes state and completes or interrupts an electrical circuit between a pair of electrical terminals 158 of the switch 154.

The outputs of the position sensor 150 and the vacuum switch 154 are electrically connected to the control element C. The change of state in the vacuum switch 154 is sensed by the control element C, and compared to the current angular position of the swing arm shaft 26 as sensed by the position sensor 150. If the vacuum switch 154 is not sensing a vacuum while the position sensor 150 is indicating that the swing arm shaft 26 is positioned within the grasp-and-hold portion of the angular movement between the front and rear angular positions 32, 30 of the swing arm shaft 26, the control element C shuts down the swing-arm machine 10 and alerts the operator of the machine 10.

It is contemplated that the control element C may take many forms, such as a simple switch or relay operated electrical circuit, or a more complex embodiment including electronic control elements or a microprocessor. For convenience and ease of use, it is contemplated that it may be desirable to locate the control element C within the pedestal 120, with the pedestal 120 also including an electrical connector for connecting the control element C to an electrical harness extending from the vacuum switch 154 and the position sensor 150. We further contemplate that the pedestal 120 may include other control and enunciation elements, such as switches and indicator lights, for turning the swing arm machine 10 on and off, and for jogging the motion of the swing arm shaft 26 and actuator arm 44 during setup and troubleshooting of the front mounted feeder apparatus 40.

Those having skill in the art will recognize that, while we presently consider it preferable to have the components according to our invention arranged as described above, we contemplate many other arrangements within the scope of our invention. For example, although all embodiments discussed above disclose the use the swing arm 24 to feed a first item 17 at a station 16 equipped with front mounted feeder means 42 according to our invention, the swing arm 24 at that station 16 may be removed or disabled so that only the product 38 is being fed at that station 16. Our invention may also be practiced in many embodiments other than those depicted.

In summary therefore, while the embodiments of our invention disclosed herein are presently considered to be preferred, various changes and modifications can be made without departing from the spirit and scope of the invention. The scope of the invention is indicated in the appended claims, and all changes or modifications within the meaning and range of equivalents are intended to be embraced therein.

We claim:

1. A method for operating a swing arm insertion machine having a station including a swing arm shaft pivotable about an axis from a front to a rear angular position, and adapted for fixed attachment and angular movement therewith of a swing arm including gripper means for grasping a first item from the rear of a raceway of the swing arm insertion machine when the swing arm shaft is in the rear angular position and for placing the first item into the raceway as the swing arm shaft moves from the rear to the front angular position, the method comprising:

fixedly attaching to the swing arm shaft at the station of the swing arm insertion machine for angular movement with the swing arm shaft, actuator arm means having means for gripping a product from the front of the raceway when the swing arm shaft is in the front angular position and for placing the product into the raceway as the swing arm shaft pivots from the front to the rear angular position; and feeding a product from the front of the raceway into the raceway with the actuator arm means.

2. The method of claim 1 further comprising:

depositing one of the first items into the raceway at the station as the swing arm shaft pivots from the rear angular position to the front angular position; and depositing a product into the raceway as the swing arm shaft pivots from the front angular position to the rear angular position.

3. A front mounted product feeder apparatus comprising:

a swing arm inserting machine that includes an insertion station, a raceway for moving inserted material from the station, a hopper at the station on a rear side of the raceway for holding a plurality of first items to be inserted into the raceway at the station, a swing arm shaft pivotable about a swing arm shaft axis from a rear angular position to a front angular position of the shaft and adapted for fixed attachment of one end of a swing arm having gripping means at a distal end thereof for gripping one of the first items in the hopper when the swing arm shaft is pivoted to the rear angular position and for depositing the first item into the raceway as the swing arm shaft pivots from the rear to the front angular position of the swing arm shaft; and front mounted product feeder means operably connected to the swing arm shaft for feeding a product into the raceway at the station from a front side of the raceway.

4. The apparatus of claim 1 wherein the front mounted product feeder means includes actuator arm means comprising:

an actuator arm having one end thereof adapted for fixed attachment to the swing arm shaft for pivotal movement of the actuator arm with the swing arm shaft about the swing arm shaft axis between the front and rear angular positions of the swing arm shaft, the actuator arm also having a distal end thereof adapted for attachment of product gripper means; and product gripper means operably attached to the distal end of the actuator arm for gripping a product on the front side of the raceway while the swing arm shaft is in the front angular position and for placing the product in the raceway as the swing arm shaft moves from the front to the rear angular position of the swing arm shaft.

5. The apparatus of claim 4 wherein the product gripper means includes a suction cup for grasping the product.

6. The apparatus of claim 5 further including valve means for connecting and disconnecting the suction cup from a source of vacuum, the valve means connecting the suction cup to the source of vacuum during a grasp and hold portion of the angular movement of the swing arm shaft between the front and rear angular positions of the swing arm shaft wherein the actuator arm means are grasping the product, the valve means disconnecting the suction cup from the source of vacuum during a product placement portion of the angular movement of the swing arm shaft between the front and rear angular positions of the swing arm shaft wherein the actuator gripper means are positioned over the raceway in such a manner that disconnection of the source of vacuum will cause the product being grasped and held by the gripper means to be released from the gripper means and dropped into the raceway.

7. The apparatus of claim 6 further including control means for sensing that the product gripper means are properly delivering a product to the raceway.

8. The apparatus of claim 7 wherein the control means include:

position sensing means operably connected to the swing arm shaft for sensing that the shaft is in the grasp and hold portion of the angular movement between the front and rear angular positions of the swing arm shaft; and vacuum sensing means operably connected to the suction cup for ascertaining that there is vacuum at the cup caused by a product being grasped by the suction cup when the suction cup is connected to the source of vacuum.

9. The apparatus of claim 6 wherein the product gripper means includes:

a product vacuum plate support shaft pivotably mounted to the distal end of the actuator arm for rotation about a support shaft axis;

a product vacuum plate fixedly attached to the vacuum plate support shaft for rotation therewith about the support shaft axis, the vacuum plate having means for attaching the suction cup thereto and connecting the suction cup to the source of vacuum;

a first stop extending from the actuator arm and operably bearing against the product vacuum plate at a first angular position of the product vacuum plate with respect to the actuator arm;

a torsion spring operably connected between the actuator arm and the product vacuum plate support shaft for urging the product vacuum support plate to pivot about the support shaft axis to the first angular position of the product vacuum plate whereat the product vacuum plate bears against the first stop; and second stop means including a second stop attached to and extending from the swing arm inserting machine in a fixed relationship to the raceway, the second stop having a distal end thereof configured to operably bear against the product vacuum support plate for rotating the product vacuum plate from the first angular position of the product vacuum plate with respect to the actuator arm to a second angular position of the product vacuum plate with respect to the actuator arm, as the actuator arm moves from the front to the rear angular position of the actuator arm.

10. The apparatus of claim 9 wherein the valve means includes:

a stationary sealing block attached to the actuator arm and having a sealing face thereof adapted for sliding contact with a sealing face of a rotating vacuum block; and a rotating vacuum block fixedly attached to the product vacuum plate support shaft for rotation therewith, the rotating vacuum block having a vacuum passage therein including a vacuum inlet port for attachment of the vacuum passage to a source of vacuum and an outlet port for attachment of the vacuum passage to the product vacuum plate, the rotating vacuum block further having a sealing face thereof adapted for sliding contact with the sealing face of the stationary sealing block, the sealing face of the rotating valve block defining a control port therein connected to the vacuum passage and disposed upon the sealing face of the rotating block in such a position that the control port is closed by the sealing face of the stationary block until the product vacuum plate is adjacent the second angular position of the product vacuum plate with respect to the actuator arm, whereat the control port is uncovered thereby releasing the vacuum in the vacuum passage.

11. The apparatus of claim 1 further including a product support feeder channel attached at the front side of the raceway.

12. The apparatus of claim 11 further including means for mounting and aligning the product support channel with the product gripper means.

13. The apparatus of claim 1 further comprising a swing arm operably attached to the swing arm shaft at the station and having gripping means at a distal end thereof for gripping one of the first items in the hopper when the swing arm shaft is pivoted to the rear angular position and for depositing the first item into the raceway as the swing arm shaft pivots from the rear to the front angular position of the swing arm shaft, the swing arm and actuator arm thereby respectively depositing one of the first items and a product into the raceway at the station as the swing arm shaft pivots from the rear to the front, and the front to the rear angular positions respectively.

14. A front mounted product feeder apparatus for a swing arm inserting machine that includes an insertion station, a raceway for moving inserted material from the station, a hopper at the station on a rear side of the raceway for holding a plurality of first items to be inserted into the raceway at the station, a swing arm shaft pivotable about a swing arm shaft axis from a rear angular position to a front angular position of the shaft and adapted for fixed attachment of one end of a swing arm having gripping means at a distal end thereof for gripping one of the first items in the hopper when the swing arm shaft is pivoted to the rear angular position and for depositing the first item into the raceway as the swing arm shaft pivots from the rear to the front angular position of the swing arm shaft, the front mounted product feeder apparatus comprising:

an actuator arm having one end thereof adapted for fixed attachment to the swing arm shaft for pivotal movement of the actuator arm with the swing arm shaft about the swing arm shaft axis between the front and rear angular positions of the swing arm shaft, the actuator arm also having a distal end thereof adapted for attachment of product gripper means; and product gripper means operably attached to the distal end of the actuator arm for gripping a product on the front side of the raceway while the swing arm shaft is in the front angular position and for placing the product in the raceway as the swing arm shaft moves from the front to the rear angular position of the swing arm shaft.

15. The apparatus of claim 14 wherein the product gripper means includes a suction cup for grasping the product.

16. The apparatus of claim 15 further including valve means for connecting and disconnecting the suction cup from a source of vacuum, the valve means connecting the suction cup to the source of vacuum during a grasp and hold portion of the angular movement of the swing arm shaft between the front and rear angular positions of the swing arm shaft wherein the actuator arm means are grasping the product, the valve means disconnecting the suction cup from the source of vacuum during a product placement portion of the angular movement of the swing arm shaft between the front and rear angular positions of the swing arm shaft wherein the actuator gripper means are positioned over the raceway in such a manner that disconnection of the source of vacuum will cause the product being grasped and held by the gripper means to be released from the gripper means and dropped into the raceway.

17. The apparatus of claim 16 further including control means for sensing that the product gripper means are properly delivering a product to the raceway.

18. The apparatus of claim 17 wherein the control means include:

position sensing means operably connected to the swing arm shaft for sensing that the shaft is in the grasp and hold portion of the angular movement between the front and rear angular positions of the swing arm shaft; and vacuum sensing means operably connected to the suction cup for ascertaining that there is vacuum at the cup caused by a product being grasped by the suction cup when the suction cup is connected to the source of vacuum.

19. The apparatus of claim 18 wherein the product gripper means includes:

a product vacuum plate support shaft pivotably mounted to the distal end of the actuator arm for rotation about a support shaft axis;

a product vacuum plate fixedly attached to the vacuum plate support shaft for rotation therewith about the support shaft axis, the vacuum plate having means for attaching the suction cup thereto and connecting the suction cup to the source of vacuum;

a first stop extending from the actuator arm and operably bearing against the product vacuum plate at a first angular position of the product vacuum plate with respect to the actuator arm;

a torsion spring operably connected between the actuator arm and the product vacuum plate support shaft for urging the product vacuum support plate to pivot about the support plate axis to the first angular position of the product vacuum plate whereat the product vacuum plate operably bears against the first stop; and second stop means including a second stop attached to and extending from the swing arm inserting machine in a fixed relationship to the raceway, and having a distal end thereof configured to operably bear against the product vacuum support plate for rotating the product vacuum plate from the first angular position of the product vacuum plate with respect to the actuator arm to a second angular position of the product vacuum plate with respect to the actuator arm, as the actuator arm moves from the front to the rear angular position of the actuator arm.

20. The apparatus of claim 19 wherein the valve means includes:

a stationary sealing block attached to the actuator arm and having a sealing face thereof adapted for sliding contact with a sealing face of a rotating vacuum block; and a rotating vacuum block fixedly attached to the product vacuum plate support shaft for rotation therewith, the rotating vacuum block having a vacuum passage therein including a vacuum inlet port for attachment of the vacuum passage to a source of vacuum and an outlet port for attachment of the vacuum passage to the product vacuum plate, the rotating vacuum block further having a sealing face thereof adapted for sliding contact with the sealing face of the stationary sealing block, the sealing face of the rotating valve block defining a control port therein connected to the vacuum passage and disposed upon the sealing face of the rotating block in such a position that the control port is closed by the sealing face of the stationary block until the product vacuum plate is adjacent the second angular position of the product vacuum plate with respect to the actuator arm, whereat the control port is uncovered thereby releasing the vacuum in the vacuum passage.

21. The apparatus of claim 14 further including a product support feeder channel attached at the front side of the raceway.

22. The apparatus of claim 21 further including means for mounting and aligning the product support channel with the product gripper means.

23. The apparatus of claim 14 further comprising a swing arm operably attached to the swing arm shaft at the station and having gripping means at a distal end thereof for gripping one of the first items in the hopper when the swing arm shaft is pivoted to the rear angular position and for depositing the first item into the raceway as the swing arm shaft pivots from the rear to the front angular position of the swing arm shaft, the swing arm and actuator arm thereby respectively depositing one of the first items and a product into the raceway at the station as the swing arm shaft pivots from the rear to the front, and the front to the rear angular positions respectively.

* * * * *